US012571584B2

(12) United States Patent
Barjhoux et al.

(10) Patent No.: US 12,571,584 B2
(45) **Date of Patent: *Mar. 10, 2026**

(54) PLANT AND METHOD FOR PRODUCING HYDROGEN AT CRYOGENIC TEMPERATURE

(71) Applicant: L'Air Liquide, Societe Anonyme pour l'Etude et l'Exploitation des Procedes Georges Claude, Paris (FR)

(72) Inventors: Pierre Barjhoux, Sassenage (FR); Pierre Crespi, Sassenage (FR)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 272 days.

This patent is subject to a terminal disclaimer.

(21) Appl. No.: 18/036,125

(22) PCT Filed: Oct. 7, 2021

(86) PCT No.: PCT/EP2021/077673

§ 371 (c)(1),
(2) Date: May 9, 2023

(87) PCT Pub. No.: WO2022/096217

PCT Pub. Date: May 12, 2022

(65) Prior Publication Data

US 2024/0019203 A1 Jan. 18, 2024

(30) Foreign Application Priority Data

Nov. 9, 2020 (FR) ..... 2011490

(51) Int. Cl.
*F25J 1/00* (2006.01)

(52) U.S. Cl.
CPC ..... *F25J 1/001* (2013.01); *F25J 2205/86* (2013.01)

(58) Field of Classification Search
CPC ..... F25J 1/001; F25J 1/005; F25J 2205/86; C25B 1/04
See application file for complete search history.

(56) References Cited

U.S. PATENT DOCUMENTS

| | | | |
|---|---|---|---|
| 4,530,744 | A | 7/1985 | Smith |
| 10,351,962 | B2 | 7/2019 | Herold et al. |

(Continued)

FOREIGN PATENT DOCUMENTS

| | | |
|---|---|---|
| JP | 2004 210597 | 7/2004 |
| JP | 2007 205667 | 8/2007 |
| WO | WO 2018/027154 | 2/2018 |

OTHER PUBLICATIONS

International Search Report and Written Report for PCT/EP2021/077673, mailed Dec. 21, 2021.
French Search Report for FR 2 011 490, mailed Aug. 2, 2021.

*Primary Examiner* — Brian M King
(74) *Attorney, Agent, or Firm* — Justin K. Murray

(57) ABSTRACT

Plant and method for producing hydrogen at cryogenic temperature, comprising: an electrolyzer; a hydrogen circuit to be cooled, comprising an upstream end connected to the hydrogen outlet and a downstream end to be connected to a member for collecting cooled and/or liquefied hydrogen, the plant also comprising a set of heat exchanger(s) in heat exchange with the hydrogen circuit to be cooled, the plant comprising at least one cooling device in heat exchange with at least a portion of the set of heat exchanger(s), the plant further comprising an oxygen circuit comprising an upstream end connected to the oxygen outlet and a downstream end, the oxygen circuit comprising a system for expanding the oxygen stream and at least one heat exchange between the expanded oxygen stream and the hydrogen circuit to be cooled, characterized in that the oxygen circuit comprises at least one oxygen compressor arranged (Continued)

upstream of the oxygen stream expansion system, the oxygen stream expansion system comprising an expansion turbine and in that said expansion turbine and said compressor are coupled to the same rotating shaft to transfer expansion work from the pressurized oxygen stream to the compressor in order to compress the oxygen stream upstream of the turbine.

21 Claims, 4 Drawing Sheets

(56) References Cited

U.S. PATENT DOCUMENTS

| | | | | |
|---|---|---|---|---|
| 2010/0280135 | A1* | 11/2010 | Doty | C01B 3/36 518/703 |
| 2017/0145570 | A1* | 5/2017 | Herold | C25B 1/04 |
| 2018/0313604 | A1 | 11/2018 | Cardella et al. | |
| 2019/0310013 | A1* | 10/2019 | Zielinski | F25J 1/0072 |
| 2022/0128298 | A1* | 4/2022 | Thomas | F25J 1/0055 |

* cited by examiner

[FIG.1]
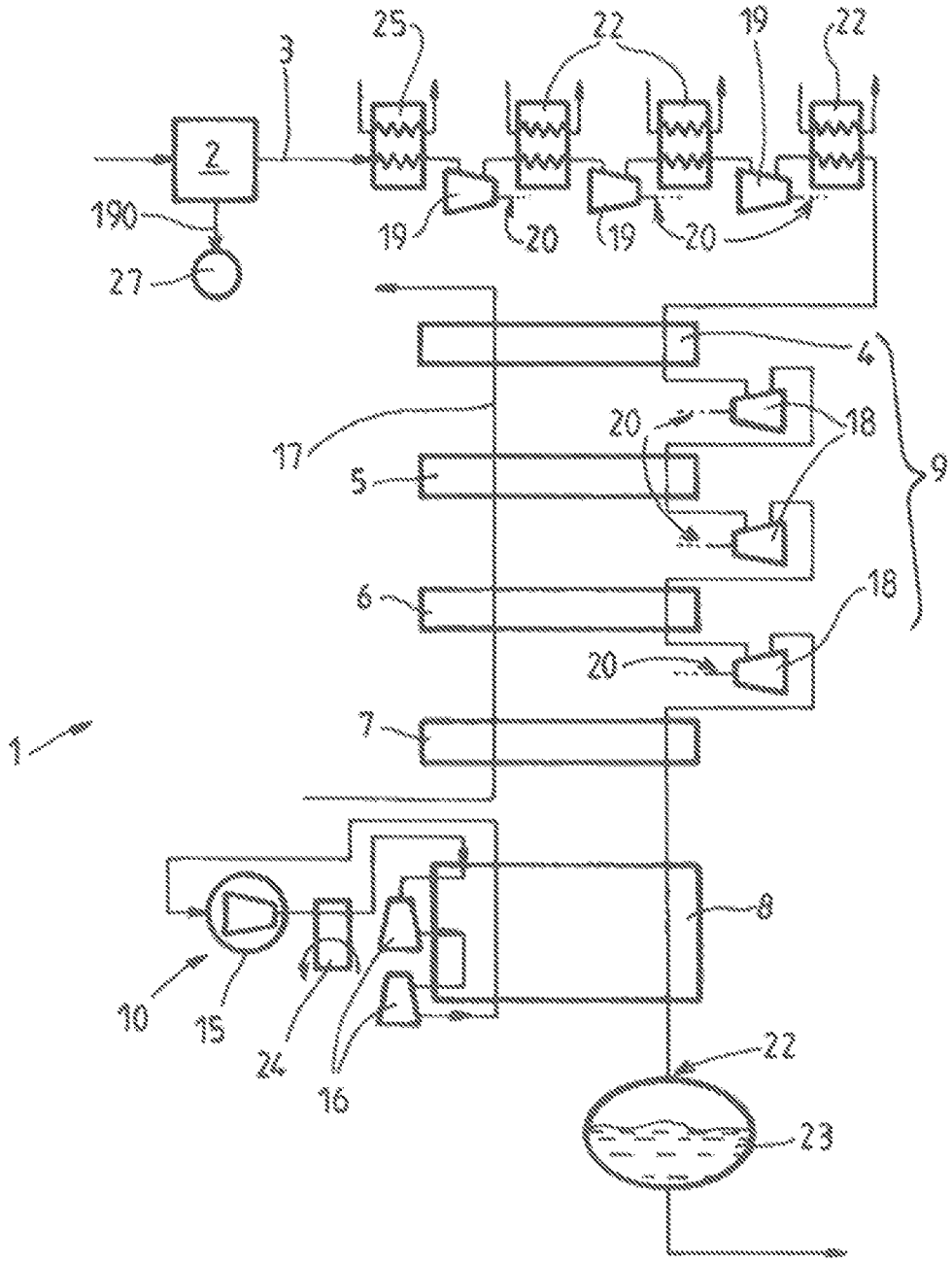

[FIG.2]
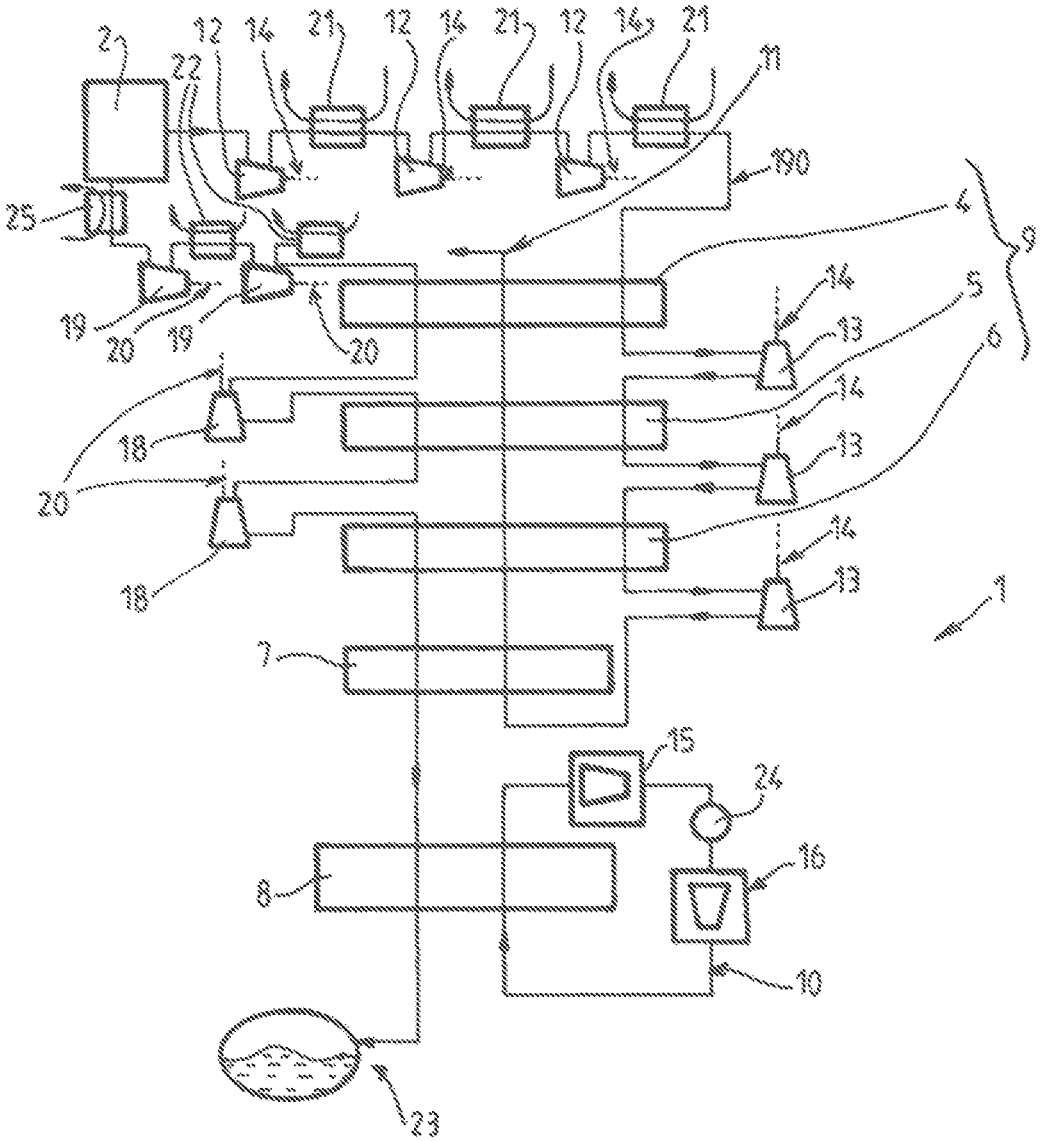

[FIG.3]
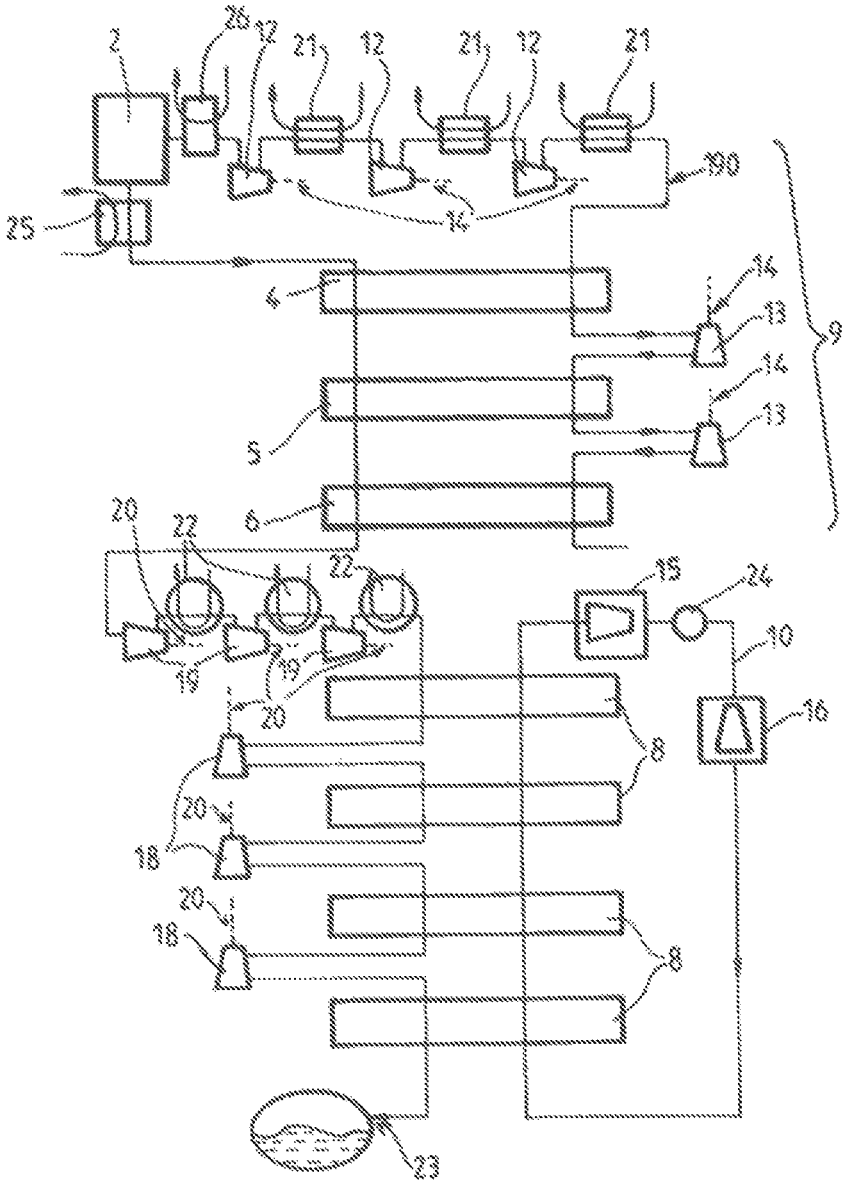

[FIG.4]
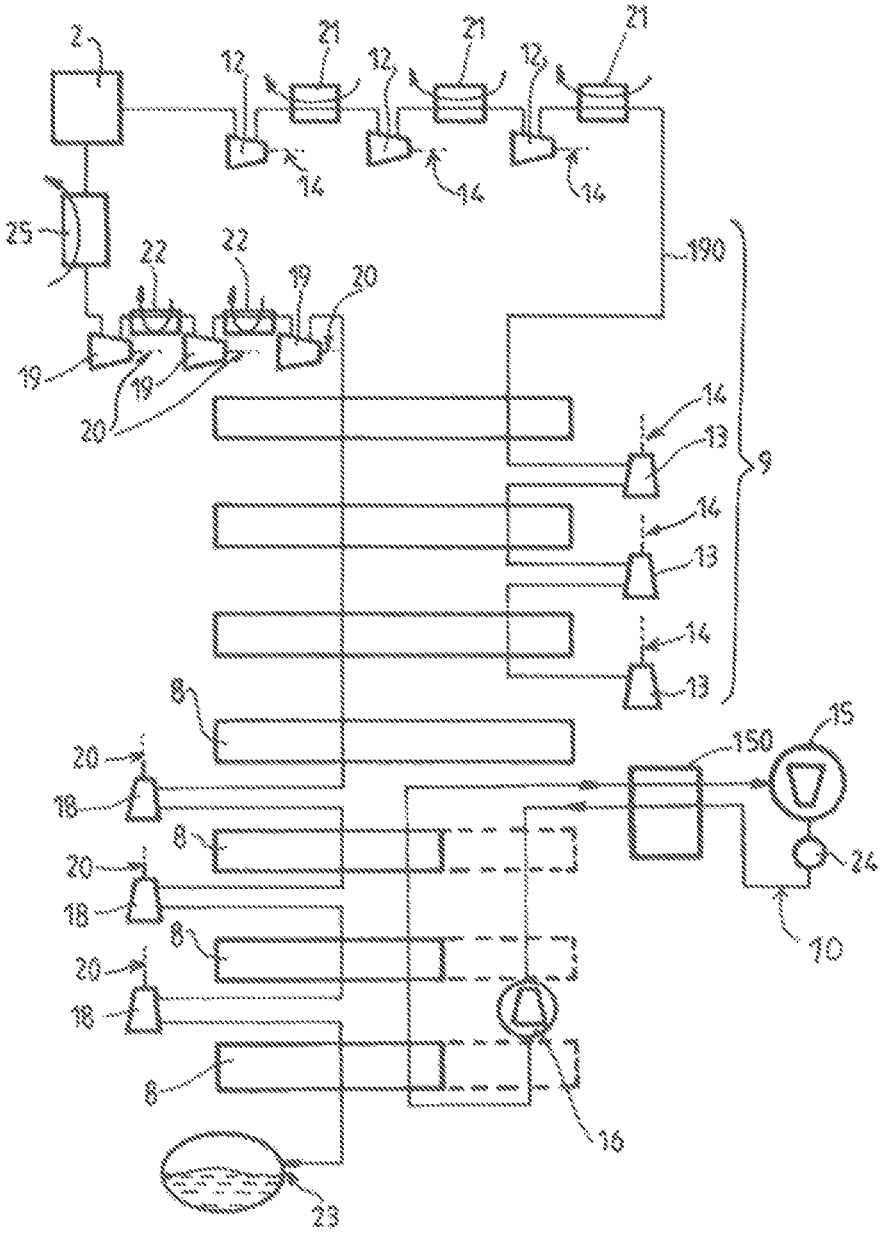

PLANT AND METHOD FOR PRODUCING HYDROGEN AT CRYOGENIC TEMPERATURE

CROSS REFERENCE TO RELATED APPLICATIONS

This application is a § 371 of International PCT Application PCT/EP2021/077673, filed Oct. 7, 2021, which claims the benefit of FR2011490, filed Nov. 9, 2020, both of which are herein incorporated by reference in their entireties.

FIELD OF THE INVENTION

The invention relates to a plant and a method for producing hydrogen at cryogenic temperature.

BACKGROUND OF THE INVENTION

The two main ways to produce hydrogen (molecular hydrogen H2) are: electrolysis and chemical production by steam methane reforming (SMR).

In the case of electrolysis, the water molecule is split and this produces hydrogen on the one hand and oxygen (O2) on the other. As regards electrolysis technologies, there are three main families: "PEM" (Proton Exchange Membrane), "Alkaline" and "Solid Oxide".

These technologies operate optimally at a pressure close to atmospheric pressure for reasons of energy performance and efficiency of the chemical reaction of splitting the water molecule.

PEM technology makes it possible to operate at high pressures without significantly impacting the energy performance of the electrolysis. For example, in the prior art, electrolyzers of several megawatts of power can produce hydrogen and oxygen at 30 bar abs at room temperature.

Although described for example in documents U.S. Pat. No. 4,530,744 or U.S. 10,351,962, harnessing the oxygen produced under high pressure is generally not carried out industrially.

These known solutions are however of little interest industrially in hydrogen liquefaction processes because they are not very energy efficient.

SUMMARY OF THE INVENTION

The present invention proposes an innovative plant and method for harnessing the oxygen produced, in particular in the case of an electrolyzer operating at high pressure.

One aim of the present invention is to overcome all or some of the drawbacks of the prior art set out above.

To this end, the plant according to certain embodiments of the invention, which moreover complies with the generic definition given in the preamble above, is essentially characterized in that the oxygen circuit comprises at least one oxygen compressor arranged upstream of the oxygen flow expansion system, the oxygen flow expansion system comprising an expansion turbine, said expansion turbine and said compressor being coupled to the same rotary shaft to transfer work of expanding the oxygen flow under pressure to the compressor to compress the oxygen flow upstream of the turbine.

Such a plant makes it possible to efficiently harness the oxygen (in particular at high pressure) produced by an electrolyzer to pre-cool a flow of hydrogen to a cryogenic temperature.

This solution makes it possible to reduce the investment costs for such a plant, in particular by eliminating or reducing the cooling down to 80 to 130 K of the hydrogen to be liquefied. This makes it possible, for example, to reduce or dispense with a liquid nitrogen pre-cooling system with a nitrogen compression station as found in the prior art.

The solution makes it possible to significantly reduce the corresponding operating costs for such a plant (for example 30% less on specific energy, for example kWh/kg of liquefied H2).

In certain embodiments, the invention relates more particularly to a plant for producing hydrogen at cryogenic temperature, in particular liquefied hydrogen, comprising an electrolyzer provided with an oxygen outlet and a hydrogen outlet, a hydrogen circuit to be cooled comprising an upstream end connected to the hydrogen outlet and a downstream end intended to be connected to a member for collecting cooled and/or liquefied hydrogen, the plant comprising a set of heat exchanger(s) exchanging heat with the hydrogen circuit to be cooled, the plant comprising at least one cooling device exchanging heat with at least part of the set of heat exchanger(s), the plant comprising an oxygen circuit comprising an upstream end connected to the oxygen outlet and a downstream end, the oxygen circuit comprising an oxygen flow expansion system and at least one exchange of heat between the expanded oxygen flow and the hydrogen circuit to be cooled.

Furthermore, embodiments of the invention may include one or more of the following features:

- the assembly comprising the expansion turbine and the compressor coupled to the same rotary shaft is a passive mechanical system, that is to say that it does not include a motor for driving the rotary shaft other than the oxygen flow, or an active mechanical system, that is to say including a motor for driving the rotary shaft,
- the oxygen circuit comprises several oxygen compressors arranged in series and/or in parallel upstream of the oxygen flow expansion system, the oxygen flow expansion system comprising a plurality of expansion turbines, each of the compressors being coupled to a rotary shaft to which at least one turbine is also coupled,
- the oxygen circuit comprises several compressors arranged in series upstream of the oxygen flow expansion system, the oxygen flow expansion system comprising a plurality of expansion turbines and in that the compressors and turbines are coupled in pairs to respective rotary shafts,
- the turbines are arranged in series in the oxygen circuit, the oxygen circuit comprising separate respective portions for heat exchange between the set of heat exchanger(s) and the oxygen flow at the outlet of each turbine,
- the plant comprises an oxygen cooling system at the outlet of at least some of the compressors,
- the set of heat exchanger(s) comprises several heat exchangers arranged in series and exchanging heat with the hydrogen circuit to be cooled between the upstream and downstream ends of the hydrogen circuit to be cooled,
- the plant comprises a first cooling device and a second cooling device exchanging heat with the hydrogen circuit to be cooled, the first cooling device exchanging heat with a first group of heat exchanger(s) of the set of heat exchanger(s), the second cooling device exchanging heat with a second group of heat exchangers, the first group of heat exchanger(s) being located upstream of the second group of heat exchangers in the hydrogen circuit to be cooled, the first cooling device comprising the exchange of heat between the expanded oxygen flow and the hydrogen circuit to be cooled to ensure pre-cooling of the hydrogen circuit before the additional cooling carried out by the second cooling device, the second cooling device comprises a cycle gas refrigeration cycle refrigerator, in which the refrigerator of the second cooling device comprises, arranged in series in a cycle circuit: a mechanism for compressing the second cycle gas, a member for cooling the second cycle gas, a mechanism for expanding the second cycle gas and a member for heating the expanded second cycle gas, the plant comprises a third cooling device exchanging heat with at least part of the first group of heat exchanger(s), the hydrogen circuit to be cooled comprises a hydrogen flow expansion system, the hydrogen circuit to be cooled comprising at least one hydrogen compressor upstream of the hydrogen flow expansion system, the hydrogen flow expansion system comprising an expansion turbine, said expansion turbine and said compressor being coupled to the same rotary shaft to transfer work of expanding the hydrogen flow under pressure to the compressor to compress the hydrogen flow upstream of the turbine, the assembly with expansion turbine and compressor coupled to the same rotary shaft is preferably a passive mechanical system, that is to say that it does not include a motor for driving the rotary shaft other than the hydrogen flow, the hydrogen circuit comprises several hydrogen compressors arranged in series and/or in parallel upstream of the hydrogen flow expansion system, the hydrogen flow expansion system comprising a plurality of expansion turbines arranged in series and/or in parallel, and in that each of the compressors is coupled to a rotary shaft to which at least one turbine is also coupled, the hydrogen circuit to be cooled comprises several compressors arranged in series upstream of the hydrogen flow expansion system, the hydrogen flow expansion system comprising a plurality of expansion turbines arranged in series, the compressors and turbines being coupled in pairs to respective rotary shafts, the turbines are arranged in series in the hydrogen circuit to be cooled, the hydrogen circuit to be cooled comprising separate respective portions for heat exchange between the set of heat exchanger(s) and the hydrogen flow at the outlet of each turbine, the hydrogen flow expansion system is located on a portion of the hydrogen circuit to be cooled exchanging heat with the first group of heat exchanger(s), the hydrogen flow expansion system is located on a portion of the hydrogen circuit to be cooled exchanging heat with the second group of heat exchanger(s), the plant comprises a hydrogen cooling system at the outlet of at least some of the compressors.

The invention also relates to a method for producing hydrogen at cryogenic temperature, in particular liquefied hydrogen, using a plant according to any one of the preceding features, the method comprising a step of supplying, by the electrolyzer, a hydrogen flow to the upstream end of the hydrogen circuit, for example at a pressure of between 15 and 150 bar, a step of supplying, by the electrolyzer, an oxygen flow to the upstream end of the oxygen circuit, for example at a pressure of between 15 and 150 bar, the method comprising a step of compression then expansion of the oxygen flow in which the expansion is carried out by at least one turbine coupled to a shaft, the shaft also being coupled to at least one compressor ensuring the compression of the oxygen flow before its expansion, the method comprising an exchange of heat between the expanded oxygen flow and the hydrogen flow with a view to cooling same.

According to other possible distinctive features:

the method comprises a step of compression then expansion of the hydrogen flow with a view to cooling same, in which the expansion is carried out by at least one turbine coupled to a shaft, the shaft also being coupled to at least one compressor ensuring the compression of the hydrogen flow before its expansion.

The invention may also relate to any alternative device or method comprising any combination of the features above or below within the scope of the claims.

BRIEF DESCRIPTION OF THE DRAWINGS

Further features, advantages and possible applications of the invention are apparent from the following description of working and numerical examples and from the drawings. All described and/or depicted features on their own or in any desired combination form the subject matter of the invention, irrespective of the way in which they are combined in the claims or the way in which said claims refer back to one another.

FIG. 1 shows a partial and schematic view illustrating a first embodiment of the structure and operation of a plant according to the invention, FIG. 2 shows a partial and schematic view illustrating a second embodiment of the structure and operation of a plant according to the invention, FIG. 3 shows a partial and schematic view illustrating a third embodiment of the structure and operation of a plant according to the invention, FIG. 4 shows a partial and schematic view illustrating a fourth embodiment of the structure and operation of a plant according to the invention.

DETAILED DESCRIPTION OF THE INVENTION

The hydrogen production plant 1 shown is a device for producing hydrogen at cryogenic temperature, in particular liquefied hydrogen.

This plant 1 comprises an electrolyzer 2, preferably of "PEM" (proton exchange membrane) type operating at high pressure, that is to say producing gaseous hydrogen and oxygen at pressures of between 15 and 150 bar, for example equal to 30 bar.

The electrolyzer 2 has an oxygen outlet and a hydrogen outlet.

The plant 1 comprises a hydrogen circuit 3 (or pipe(s)) to be cooled having an upstream end connected to the hydrogen outlet of the electrolyzer 2 and a downstream end 23 intended to be connected to a member for collecting cooled and/or liquefied hydrogen (storage and/or user application for example).

The plant 1 comprises a set of heat exchanger(s) 4, 5, 6, 7, 8 exchanging heat with the hydrogen circuit 3 to be cooled, with the aim of reaching a temperature favorable to the liquefaction of hydrogen.

As shown, at least one separate heat exchanger 25 may be provided at the outlet of the electrolyzer to cool the hydrogen flow (for example by heat exchange with a heat transfer fluid such as water or air for example) to bring the latter to a temperature close to ambient temperature. The electrochemical reaction for the production of hydrogen by electrolysis generally leads to a rise in temperature of a few dozen degrees.

The plant 1 further comprises at least one cooling device 9, 10 exchanging heat with at least part of the set of heat exchanger(s) 4, 5, 6, 7, 8.

Moreover, the plant 1 comprises an oxygen circuit 190 (at least one pipe) comprising an upstream end connected to the oxygen outlet of the electrolyzer 2 and a downstream end 11. The downstream end may be connected for example to a device for collecting and/or using oxygen.

This oxygen circuit 190 comprises an oxygen flow expansion system 13 and at least one exchange of heat between the expanded oxygen flow (which is thus cooled by the expansion) and the hydrogen circuit 3 to be cooled. This exchange of heat may in particular be used to pre-cool the hydrogen in its refrigeration and/or liquefaction process.

According to one advantageous distinctive feature, the oxygen circuit 190 comprises at least one oxygen compressor 12 arranged upstream of the oxygen flow expansion system 13. The oxygen flow expansion system 13 comprises at least one expansion turbine 13. Said oxygen expansion turbine 13 and said upstream oxygen compressor 12 are coupled to the same rotary shaft 14 to transfer work of expanding the oxygen flow under pressure to the compressor 12 to compress the oxygen flow upstream of the expansion turbine 13.

The assembly comprising the expansion turbine 13 and the compressor 12 coupled to the same rotary shaft 14 is preferably a passive mechanical system, that is to say that it does not include a motor for driving the rotary shaft 14 other than the oxygen flow. Thus, the expansion turbine 13 is mechanically braked by the compressor 12 coupled to the same shaft 14. Of course, this is not limiting, and it could thus be envisaged to provide a system with a motor with its shaft coupled to the turbine(s) and compressor(s) (to improve the efficiency of the plant where appropriate).

This transfer of work produces "turboboosting" which therefore consists in integrating one or more cryogenic expansion turbines 13 for which the working fluid is the oxygen previously produced by the electrolyzer 2. The system for braking these turbines is one or more compressors 12 coupled to the same shaft 14. This makes it possible to inject the work of expanding this gas flow as a flow booster upstream at ambient temperature.

As shown, to transfer this cold energy produced to the hydrogen flow, it is possible to integrate in the exchanger or exchangers 4, 5, 6, 7 specific passages, independent of the main hydrogen flow, to allow the cooled oxygen to exchange cold energy/heat energy with the hydrogen to be cooled.

The integration of the expanded oxygen flow in the array of heat exchangers 4, 5, 6, 7 of the hydrogen refrigeration/liquefaction system makes it possible in particular to reduce its volume. Costs are also reduced by sharing the heat exchange lines in one and the same piece of equipment. Furthermore, it is possible to use a typically inert intermediate heat transfer fluid, helium, nitrogen, argon, for example, so as not to risk bringing hydrogen and oxygen into contact in the same piece of equipment.

This cold provided without any energy consumption makes it possible to reduce the work to be input to cool the hydrogen down to its target temperature (for example via a second cooling device 10 as described in more detail below).

For example, the hydrogen is cooled down to a target temperature of around 20 K, for example. To this end, the hydrogen flow may be pre-cooled from the temperature at the outlet of the electrolyzer down to a temperature of between 220 and 90 K, and for example of around 100 K.

Before expansion (downstream of the compressors 12), the oxygen may for example be brought to a pressure of between 15 and 150 bar and to a temperature close to ambient temperature, thanks to exchangers for cooling between compression stages (then at the end) which have a cold source such as industrial water for example. All or some of this pre-cooling may be carried out via expanded oxygen as described above.

As shown in FIG. 1, the plant 1 may comprise a third cooling device 17 exchanging heat with at least some of the heat exchangers 4, 5, 6, 7. This third cooling device 17 may comprise a cooling fluid loop (liquid nitrogen for example circulating counter-currently) which supplies cold to the heat exchanger(s) 4, 5, 6, 7 to also ensure some of the hydrogen pre-cooling.

The pre-cooling carried out via oxygen as described above may in particular make it possible to reduce (in particular halve) the consumption of such a cooling fluid (such as liquid nitrogen or with a gas mixing cycle for example).

The inventors have determined in particular that this harnessing of the oxygen pressure with overpressure allows a saving of approximately 45% on the consumption of liquid nitrogen (saving on electrical energy consumed to produce liquid nitrogen) for a plant with a daily production of 25 tons of hydrogen to be cooled from 300 K to 85 K.

Naturally, this advantage still stands in the event of use of another pre-cooling device (nitrogen cycle cooler, for example).

In the case where the pressure of the oxygen flow at the outlet of the electrolyzer 2 is around 70 bar, it is possible to achieve a saving on operating costs of around 50 to 70% for the function of pre-cooling of the hydrogen flow.

As shown, the oxygen circuit 190 may comprise several oxygen compressors 12 arranged in series upstream of the oxygen flow expansion system 13. The oxygen flow expansion system for its part comprises a plurality of expansion turbines 13 and each of the compressors 12 is coupled to a rotary shaft 14 to which at least one turbine 13 is also coupled.

For example, all or some of these elements could be integrated into a (for example single) turbomachine having n turbines and n compressors mounted on either side of the same shaft.

In the non-limiting example shown, the oxygen circuit 190 comprises as many compressors 12 arranged in series upstream as expansion turbines 13 arranged in series downstream, the compressors and turbines 13 are coupled in pairs to respective rotary shafts 14. For example, the first turbine (upstream) is coupled with the first compressor (upstream), the second turbine with the second compressor, etc.

Of course, the invention is not limited to this configuration comprising only turboboosters, and it is possible to provide turboboosters of this type and, additionally, one or more conventional turbines.

Of course, some compressors or turbines may not be coupled to a shaft to which another wheel of a turbine (or respectively of a compressor) is also coupled. In other words, not all of the turbines (or compressors) are necessarily coupled to the same shaft as a compressor and vice versa. Likewise, more than two wheels (compressors and/or turbines) may be coupled to the same shaft.

Preferably, an oxygen cooling system 21 is provided at the outlet of at least some of the compressors 12. For example, a cooler (cooling exchanger in exchange with a fluid such as air or water) may be interposed at the outlet of each compressor in order to improve the isothermal efficiency of each compression stage.

The set of heat exchanger(s) 4, 5, 6, 7, 8 thus preferably comprises several heat exchangers arranged in series and exchanging heat with the hydrogen circuit 3 to be cooled between the upstream and downstream ends of the hydrogen circuit 3 to be cooled.

Furthermore, preferably, after the outlet of the turbines 13 in series, the oxygen flow respectively passes through the heat exchangers 4, 5, 6, 7 in series from upstream to downstream. This passage through the exchangers thus produces cooling or heating of the oxygen flow after each expansion stage (cooling or heating depending on the pressure conditions of the oxygen flow and the temperature of the exchanger 4, 5, 6, 7 concerned). To be specific, when the fall in pressure of the oxygen flow at the terminals of the turbine is relatively large, the exchange of heat with the heat exchanger 4, 5, 6, 7 located at the outlet will tend to heat the flow (for the purpose of thermodynamic optimization of the hydrogen flow refrigeration cycle) whereas, on the contrary, in the event of a relatively lower fall in pressure, the passage through the heat exchanger 4, 5, 6, 7 located at the outlet will tend to cool the flow (as shown in FIG. 1).

This pre-cooling of the hydrogen may be completed downstream of the circuit 3 by a second cooling device 10 exchanging heat with the hydrogen circuit 3 to be cooled.

As shown, for example, the aforementioned first cooling device 9 (expanded oxygen) is placed in heat exchange with a first upstream group of heat exchanger(s) 4, 5, 6, 7 of the set of heat exchanger(s) 4, 5, 6, 7.

The second cooling device 10 may itself be placed in heat exchange with a second downstream group of heat exchangers 8 (represented here by a single heat exchanger but several heat exchangers in series and/or in parallel may be envisaged).

After pre-cooling of the hydrogen circuit 3 to a temperature of 80 to 100 K for example, the second cooling device 10 provides additional cooling of the hydrogen, for example down to a temperature of around 20 K in order to liquefy same.

As shown schematically, the second cooling device 10 may comprise a cycle gas refrigeration cycle refrigerator (comprising for example hydrogen or helium, or neon, or an optimized combination of the three) to improve the efficiency of the device 10 for final cooling of the hydrogen. Conventionally, this refrigerator of the second cooling device 10 may comprise, arranged in series in a cycle circuit: a mechanism 15 for compressing the second cycle gas (one or more compressors), a member 24 for cooling the second cycle gas (heat exchanger(s) for example), a mechanism 16 for expanding the second cycle gas (turbine(s) and/or expansion valve(s)) and a member 8 for heating the expanded second cycle gas (heat exchangers and in particular heat exchanger(s) in exchange with the hydrogen flow to be cooled).

FIG. 2 shows another possible embodiment which differs from that of FIG. 1 essentially in that it additionally comprises a system for harnessing the pressure of the hydrogen flow to be cooled. For the sake of brevity, the same elements are not described again and are designated by the same reference numerals (the same goes for subsequent embodiments).

As shown, in the plant of FIG. 2, the hydrogen circuit 3 to be cooled comprises a hydrogen flow expansion system 18 and at least one hydrogen compressor 19 upstream of the hydrogen flow expansion system 18. As previously for the oxygen, the hydrogen flow expansion system 18 comprises at least one hydrogen flow expansion turbine 18 and said expansion turbine 18 and said compressor 19 are coupled to the same rotary shaft 20 to transfer work of expanding the hydrogen flow under pressure to the compressor 19 to compress the hydrogen flow upstream of the turbine 18. The assembly with expansion turbine 18 and compressor 19 coupled to the same rotary shaft 20 is a preferably passive mechanical system, that is to say that it does not include a motor for driving the rotary shaft 20 other than the hydrogen flow.

As shown, the hydrogen circuit 3 preferably comprises several hydrogen compressors 19 arranged in series upstream of the hydrogen flow expansion system 18. The hydrogen flow expansion system preferably comprises as many expansion turbines 18 arranged in series, each of the compressors 19 being coupled to a rotary shaft 20 to which at least one turbine 18 is also coupled. For example, the compressors 19 and turbines are associated in pairs on separate respective rotary shafts 20 (for example first compressor 19 upstream coupled with first turbine 20 upstream, etc.).

As shown, at the outlet of each turbine 18, the expanded hydrogen flow may optionally pass through separate heat exchangers respectively from upstream to downstream of the first group of heat exchanger(s) 4, 5, 6, 7, to ensure pre-cooling of the hydrogen.

These expansion stages 18 make it possible to harness the pressure of the hydrogen flow (with or without intermediate cooling). This makes it possible to replace or supplement the pre-cooling described above.

Of course, this way of expanding and harnessing the pressure of the hydrogen flow is not limited to this example. Thus, the expansion of hydrogen from ambient temperature down to a given pre-cooling temperature could be carried out in several stages of radial expansion or in a single stage of expansion, for example via a volumetric expansion valve, in particular to reduce costs.

In the embodiment of FIG. 2 the hydrogen flow compressors 19 are located upstream of the first group of exchangers 4, 5, 6, 7 for pre-cooling (for example to ambient temperature) and the turbines in the pre-cooling part (exchange of heat at the outlet of the turbines 18 with these pre-cooling heat exchangers 4, 5, 6, 7).

The embodiment of FIG. 3 differs from that of [FIG. 2] essentially in that the hydrogen flow compressors 19 are located downstream of the first group of pre-cooling exchangers 4, 5, 6 and upstream of the second group of cooling exchangers 8 (in the part of the circuit 3 where the hydrogen is already pre-cooled). In other words, the compression of the hydrogen flow is carried out after pre-cooling and before final cooling. This makes it possible to obtain a higher compression ratio on a very light H2 molecule (molar mass~2 g/mol). Furthermore, the expansion turbines 18 are interposed in the cooling part (exchange of heat at the outlet of the turbines 18 with these heat exchangers 8 of the second group).

Note also that the embodiment illustrates the optional possibility (which may be applied to the other embodiments) of providing cooling 26 of the oxygen flow leaving the electrolyzer 2 upstream of the first compressor 12.

In the embodiment of FIG. 2, the hydrogen flow compressors 19 are located upstream of the first group of pre-cooling exchangers 4, 5, 6, 7 and the turbines in the pre-cooling part (exchange of heat at the outlet of the turbines 18 with these pre-cooling heat exchangers 4, 5, 6, 7).

The embodiment of FIG. 3 differs from that of FIG. 2 essentially in that the hydrogen flow compressors 19 are located downstream of the first group of pre-cooling exchangers 4, 5, 6 and upstream of the second group of cooling exchangers 8. In other words, the compression of the hydrogen flow is carried out after pre-cooling and before cooling. Furthermore, the expansion turbines 18 are interposed in the cooling part (exchange of heat at the outlet of the turbines 18 with these heat exchangers 8 of the second group).

Note also that this embodiment illustrates the optional possibility (which may be applied to the other embodiments) of providing cooling 26 of the oxygen flow leaving the electrolyzer 2 upstream of the first compressor 12.

The embodiment of FIG. 4 differs from that of FIG. 3 essentially in that the hydrogen flow compressors 19 are located upstream of the first group of pre-cooling exchangers. In other words, the compression of the hydrogen flow is carried out before pre-cooling (to room temperature for example) while the expansion is carried out in the cold cooling part (after pre-cooling).

As shown schematically in FIG. 4 (this may apply to the other embodiments), the second refrigeration device 10 may comprise one or more turbines 16 in series and/or in parallel. Furthermore, the flows upstream and downstream of the compressor or compressors may exchange heat countercurrently in the same heat exchanger 150. The flow or flows at the outlet of the turbine or turbines may optionally exchange in the heat exchanger or exchangers 8 of the second group (depicted in dotted lines).

The turbines are preferably of the centripetal and radial technology type. This allows pooling of the expansion technologies throughout the liquefaction plant.

The compressors are preferably of the centrifugal type.

In a variant not shown in detail, the oxygen circuit 190 produces liquefied oxygen downstream, which is recovered. To this end, all or part of the oxygen flow may pass through heat exchangers separate from the exchangers 4, 5, 6, 7, 8 in exchange with the hydrogen flow.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. A plant for producing hydrogen at cryogenic temperature, in particular liquefied hydrogen, the plant comprising:

an electrolyzer provided with an oxygen outlet and a hydrogen outlet;

a hydrogen circuit to be cooled comprising an upstream end connected to the hydrogen outlet and a downstream end intended to be connected to a member for collecting cooled and/or liquefied hydrogen;

the plant comprising a set of heat exchanger(s) exchanging heat with the hydrogen circuit to be cooled;

the plant comprising at least one cooling device exchanging heat with at least part of the set of heat exchanger(s);

the plant comprising an oxygen circuit comprising an upstream end connected to the oxygen outlet and a downstream end, the oxygen circuit comprising an oxygen flow expansion system and at least one exchange of heat between the expanded oxygen flow and the hydrogen circuit to be cooled, the oxygen circuit comprising at least one oxygen compressor arranged upstream of the oxygen flow expansion system, the oxygen flow expansion system comprising an expansion turbine, and wherein said expansion turbine and said compressor are coupled to the same rotary shaft thereby forming an assembly to transfer work of expanding the oxygen flow under pressure to the compressor to compress the oxygen flow upstream of the turbine.

2. The plant as claimed in claim 1, wherein the assembly comprising the expansion turbine and the compressor coupled to the same rotary shaft is a passive mechanical system, wherein the passive mechanical system comprises an absence of a motor configured to drive the rotary shaft other than the hydrogen flow.

3. The plant as claimed in claim 1, wherein the assembly comprising the expansion turbine and the compressor coupled to the same rotary shaft is an active mechanical system, that is to say including a motor for driving the rotary shaft.

4. The plant as claimed in claim 1, wherein the oxygen circuit comprises several oxygen compressors arranged in series and/or in parallel upstream of the oxygen flow expansion system, the oxygen flow expansion system comprising a plurality of expansion turbines and in that each of the compressors is coupled to a rotary shaft to which at least one turbine is also coupled.

5. The plant as claimed in claim 1, wherein the oxygen circuit comprises several compressors arranged in series upstream of the oxygen flow expansion system, the oxygen flow expansion system comprising a plurality of expansion turbines and in that the compressors and turbines are coupled in pairs to respective rotary shafts.

6. The plant as claimed in claim 5, wherein the turbines are arranged in series in the oxygen circuit, the oxygen circuit comprising separate respective portions for heat exchange between the set of heat exchanger(s) and the oxygen flow at the outlet of each turbine.

7. The plant as claimed in claim 5, further comprising an oxygen cooling system at the outlet of at least some of the compressors.

8. The plant as claimed in claim 1, wherein the set of heat exchanger(s) comprises several heat exchangers arranged in series and exchanging heat with the hydrogen circuit to be cooled between the upstream and downstream ends of the hydrogen circuit to be cooled.

9. The plant as claimed in claim 8, wherein, the at least one cooling device exchanging heat with at least part of the set of heat exchanger(s), comprises a first cooling device and a second cooling device exchanging heat with the hydrogen circuit to be cooled, the first cooling device exchanging heat with a first group of heat exchanger(s) of the set of heat exchanger(s), the second cooling device exchanging heat with a second group of heat exchangers, the first group of heat exchanger(s) being located upstream of the second group of heat exchangers in the hydrogen circuit to be cooled, and in that the first cooling device comprises the exchange of heat between the expanded oxygen flow and the hydrogen circuit to be cooled to ensure pre-cooling of the hydrogen circuit before the additional cooling carried out by the second cooling device.

10. The plant as claimed in claim 9, wherein the second cooling device comprises a cycle gas refrigeration cycle refrigerator, in which the refrigerator of the second cooling device comprises, arranged in series in a cycle circuit: a mechanism for compressing the second cycle gas, a member for cooling the second cycle gas, a mechanism for expanding the second cycle gas and a member for heating the expanded second cycle gas.

11. The plant as claimed in claim 9, further comprising a third cooling device exchanging heat with at least part of the first group of heat exchanger(s).

12. The plant as claimed in claim 9, wherein the hydrogen circuit to be cooled comprises a hydrogen flow expansion system, the hydrogen circuit to be cooled comprising at least one hydrogen compressor upstream of the hydrogen flow expansion system, the hydrogen flow expansion system comprising an expansion turbine and in that said expansion turbine and said compressor are coupled to the same rotary shaft to transfer work of expanding the hydrogen flow under pressure to the compressor to compress the hydrogen flow upstream of the turbine.

13. The plant as claimed in claim 12, wherein the assembly with expansion turbine and compressor coupled to the same rotary shaft is a passive mechanical system, wherein the passive mechanical system comprises an absence of a motor configured to drive the rotary shaft other than the hydrogen flow.

14. The plant as claimed in claim 12, wherein the hydrogen circuit comprises several hydrogen compressors arranged in series and/or in parallel upstream of the hydrogen flow expansion system, the hydrogen flow expansion system comprising a plurality of expansion turbines arranged in series and/or in parallel, and in that each of the compressors is coupled to a rotary shaft to which at least one turbine is also coupled.

15. The plant as claimed in claim 14, wherein the several hydrogen compressors are arranged in series upstream of the hydrogen flow expansion system, the hydrogen flow expansion system comprising a plurality of expansion turbines arranged in series, and in that the compressors and turbines are coupled in pairs to respective rotary shafts.

16. The plant as claimed in claim 14, wherein the turbines are arranged in series in the hydrogen circuit to be cooled, the hydrogen circuit to be cooled comprising separate respective portions for heat exchange between the set of heat exchanger(s) and the hydrogen flow at the outlet of each turbine.

17. The plant as claimed in claim 14, wherein the hydrogen flow expansion system is located on a portion of the hydrogen circuit to be cooled exchanging heat with the first group of heat exchanger(s).

18. The plant as claimed in claim 14, wherein the hydrogen flow expansion system is located on a portion of the hydrogen circuit to be cooled exchanging heat with the second group of heat exchanger(s).

19. The plant as claimed in claim 14, further comprising a hydrogen cooling system at the outlet of at least some of the compressors.

20. A method for producing hydrogen at cryogenic temperature, in particular liquefied hydrogen, using a plant according to claim 1, the method comprising the steps of:

supplying, by the electrolyzer, a hydrogen flow to the upstream end of the hydrogen circuit at a pressure of between 15 and 150 bar;

supplying, by the electrolyzer, an oxygen flow to the upstream end of the oxygen circuit at a pressure of between 15 and 150 bar;

compressing and then expanding the oxygen flow in which the expansion is carried out by the at least one turbine coupled to the shaft, the shaft also being coupled to at least one compressor ensuring the compression of the oxygen flow before expansion; and exchanging heat between the expanded oxygen flow and the hydrogen flow.

21. The method as claim in claim 20, wherein the method comprises a step of compression then expansion of the hydrogen flow with a view to cooling same, in which the expansion is carried out by at least one turbine coupled to a shaft, the shaft also being coupled to at least one compressor ensuring the compression of the hydrogen flow before its expansion.

* * * * *